US006098820A

United States Patent [19]

Smith

[11] Patent Number: 6,098,820

[45] Date of Patent: Aug. 8, 2000

[54] TIPPING-RESISTANT DISPLAY STAND

[75] Inventor: Michael J. Smith, Orangeburg, N.Y.

[73] Assignee: Arrow Art Finishers, L.L.C., Princeton, N.J.

[21] Appl. No.: 09/187,605

[22] Filed: Nov. 6, 1998

[51] Int. Cl.[7] ..... A47B 97/08; A47F 5/00

[52] U.S. Cl. ..... 211/132.1; 211/135; 211/73; 248/174

[58] Field of Search ..... 211/132.1, 149, 211/135, 73, 74; 248/174; 108/111, 27, 162, 165; 206/740, 744, 747, 748, 45.24; 312/258, 259, 262

[56] References Cited

U.S. PATENT DOCUMENTS

| | | | |
|---|---|---|---|
| 1,683,007 | 9/1928 | Ziemmerman | 248/174 X |
| 1,734,782 | 11/1929 | Stam | 248/174 |
| 1,962,852 | 6/1934 | Ziemmerman | 248/174 |
| 2,918,178 | 12/1959 | Leone | 248/174 |
| 3,139,192 | 6/1964 | Maguire | 211/149 X |
| 3,836,104 | 9/1974 | Miller et al. . | |
| 4,570,805 | 2/1986 | Smith | 211/149 |
| 4,582,003 | 4/1986 | Valero | 211/132.1 X |
| 4,632,345 | 12/1986 | Barley | 248/174 |
| 4,723,664 | 2/1988 | Smith | 211/149 |
| 4,854,246 | 8/1989 | Belokin et al. | 108/111 |
| 5,315,936 | 5/1994 | Smith | 211/149 X |
| 5,465,851 | 11/1995 | Smith | 211/149 |
| 5,706,959 | 1/1998 | Smith | 211/132.1 |
| 5,826,732 | 10/1998 | Ragsdale | 211/149 |

FOREIGN PATENT DOCUMENTS

| | | |
|---|---|---|
| 15070/83 | 12/1984 | Australia . |
| 10313990 | 12/1998 | Japan . |

*Primary Examiner*—Daniel P. Stodola
*Assistant Examiner*—Khoa Tran
*Attorney, Agent, or Firm*—Kirschstein, et al.

[57] ABSTRACT

A display stand includes a plurality of panels which are supportably held in an erect condition by a plurality of rear support sections which are retained in a deployed condition by a pair of locking flaps which are secured in a locked condition. The stand is self-standing and resistant to tipping and overturning.

18 Claims, 3 Drawing Sheets

FIG.1
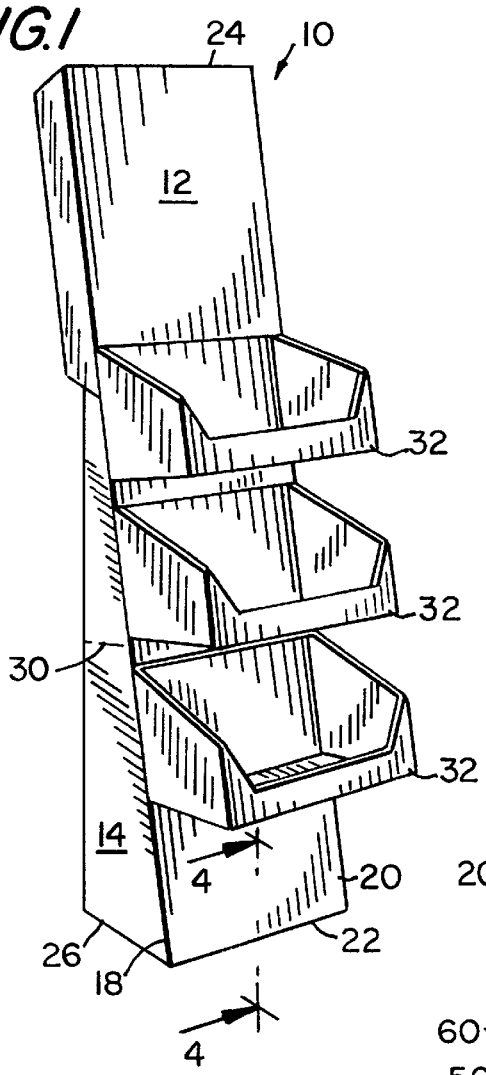
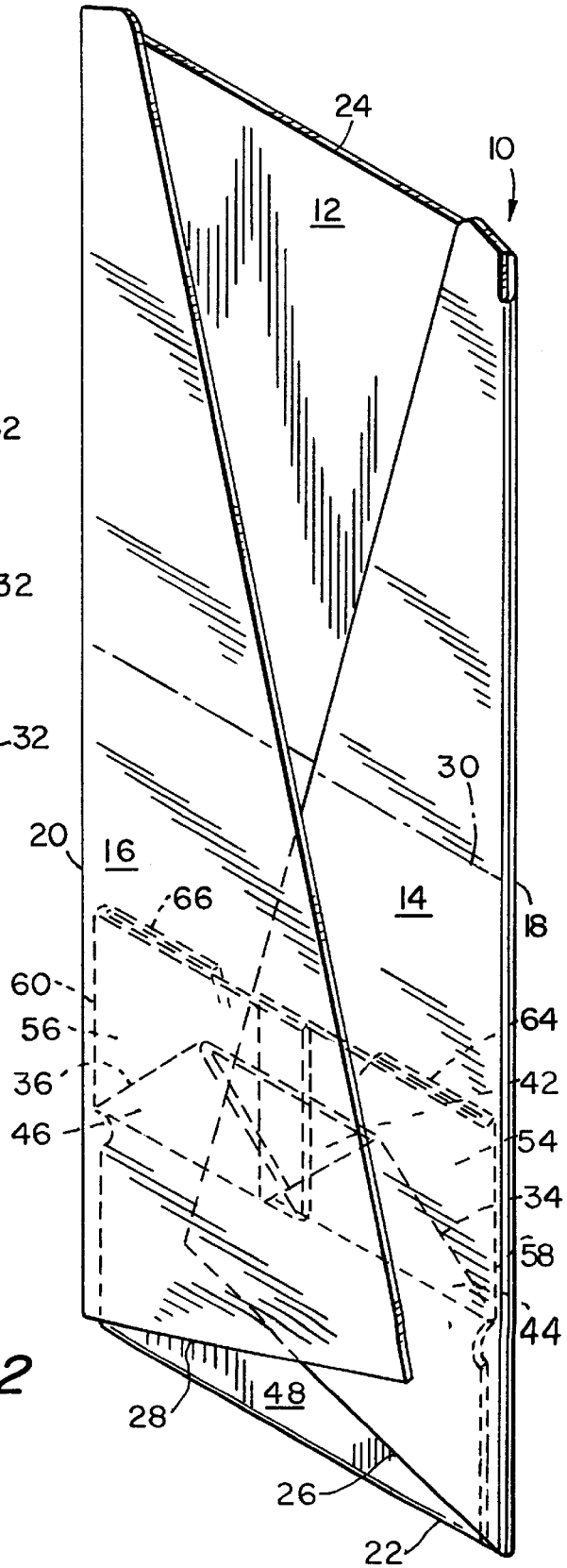
FIG.2

FIG.3
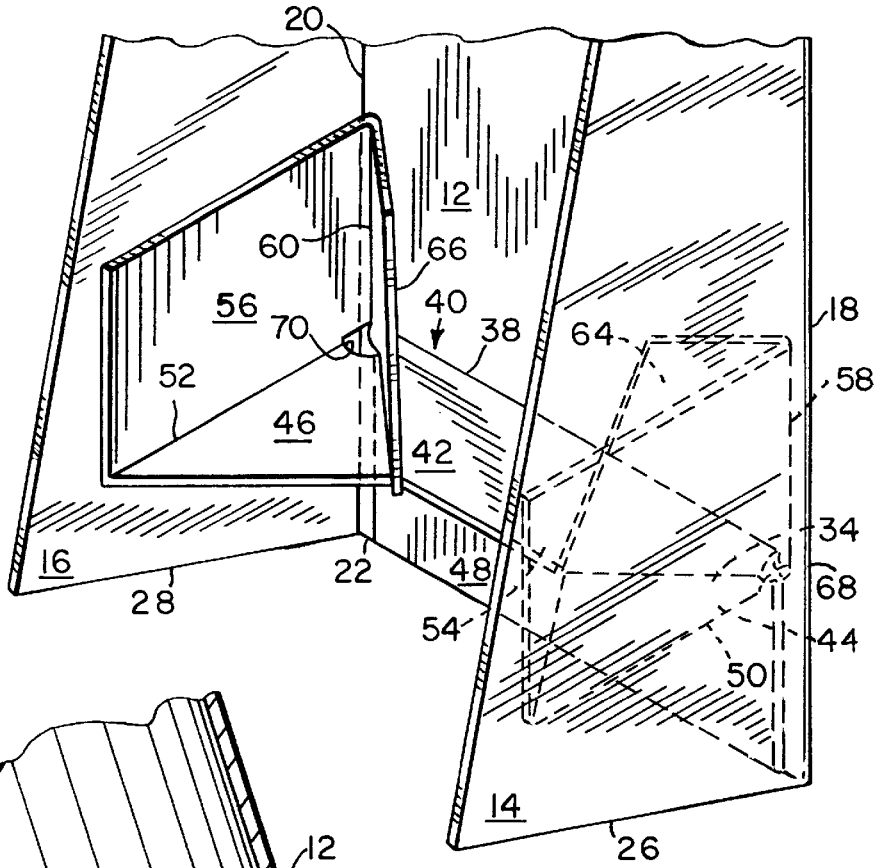
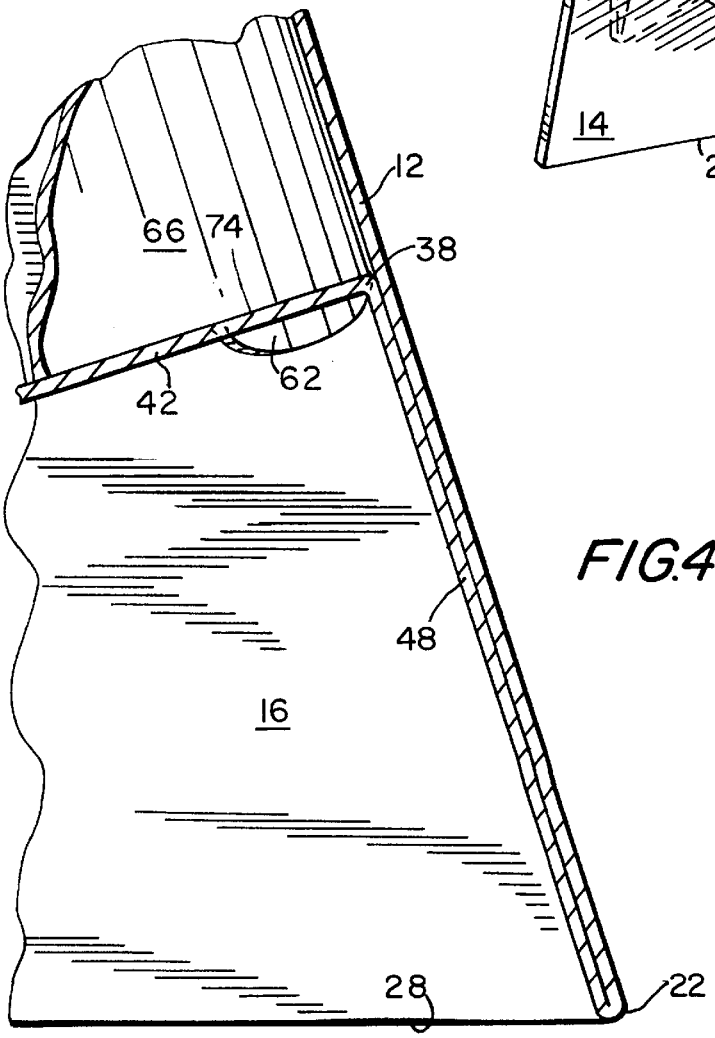
FIG.4

TIPPING-RESISTANT DISPLAY STAND

BACKGROUND OF THE INVENTION

1. Field of the Invention

This invention generally relates to a display stand for exhibiting merchandise and, more particularly, to rendering the display stand resistant to tipping and overturning, especially when bumped or pushed.

2. Description of the Related Art

Display stands for exhibiting merchandise are well known. See, for example, U.S. Pat. No. 4,506,790; No. 4,632,345 and No. 5,465,851. Such stands are often positioned in aisles in supermarkets, warehouses and department stores to exhibit the merchandise to consumers. The presence of the stands tends to narrow the aisles and, of course, there are many aisles which are narrow in the first place. Heavy inside pedestrian traffic also limits the width of such aisles and increases the likelihood that a consumer will bump or be pushed into a stand, thereby toppling the stand and the merchandise on the display.

This tipping problem is aggravated when the stand has an easel-type construction, that is, when an upright main panel of the stand is rearwardly inclined to allow the consumer greater access to the merchandise, particularly at lower elevations of the main panel. Due to its rearward slant, this type of stand is more prone to being pushed over. It is self-evident that a stand that cannot readily withstand the bumps and knocks that are commonly encountered in everyday use is unsatisfactory for its intended purpose of displaying merchandise.

SUMMARY OF THE INVENTION

OBJECTS OF THE INVENTION

Accordingly, it is a general object of the present invention to render a display stand resistant to being overturned and toppled.

More particularly, it is an object of the present invention to provide a rugged stand that will endure the expected bumps and knocks encountered in normal usage.

Still another object of the present invention is to make a stand that is not upright, that is, one that is rearwardly inclined, more resistant to tipping.

A concomitant object of the present invention is so to construct the display as to be relatively simple in construction, inexpensive to manufacture, easy to use, and yet reliable in operation.

FEATURES OF THE INVENTION

In keeping with these objects and others which will become apparent hereinafter, one feature of the tipping-resistant display stand resides, briefly stated, in a display that includes a main panel, and a pair of side panels foldably connected to the main panel and movable to an erect condition in which the side panels extend rearwardly from the main panel. A rear support includes a main section, and a pair of side sections foldably connected to the main section to move the main section. The side sections are foldably connected to the side panels and are jointly movable by the side panels to a deployed condition in which the side sections extend away from the side panels and move the main section to extend rearwardly from the main panel.

In accordance with this invention, a locking flap is movable to a locked condition in which the flap engages the rear support to resist movement of the sections out of the deployed condition. The locking flap effectively resists the display stand from being tipped or toppled from the bumps and knocks of everyday usage.

In the preferred embodiment, there are two locking flaps, each foldably connected to a respective side section for movement between an unlocked condition in which the flaps overlie the side sections, to the locked condition in which the flaps engage the side sections. The flaps preferably converge toward each other in the locked condition. Also, the side sections are foldably connected along a pair of fold lines to the main section, and the locking flaps engage the fold lines in the locked condition. Each side section has an opening, and each flap has a tab extending through and movable along the respective opening. Each opening has an abutment edge for engaging the respective tab in the locked condition.

The anti-tipping aspect of this invention is especially advantageous in the event when the main panel is rearwardly inclined relative to a generally horizontal support surface. The inclined main panel supports multiple shelves at various elevations to provide more access to the lower shelves.

The display, the rear support and the flaps are preferably constructed of corrugated board sheet material. Also, the panels, the sections and the flaps are constructed of a single piece of the sheet material.

The novel features which are considered as characteristic of the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a front perspective view on a reduced scale of a tipping-resistant display stand in an erect condition according the present invention;

FIG. 2 is an enlarged rear perspective view of the stand of FIG. 1 in a collapsed condition;

FIG. 3 is a broken-away, rear perspective view of the stand of FIG. 1 in the erect condition;

FIG. 4 is a broken-away, sectional view of a detail of FIG. 3;

DETAILED DESCRIPTION OF THE PREFERRED EMBODIMENTS

Figure 5:
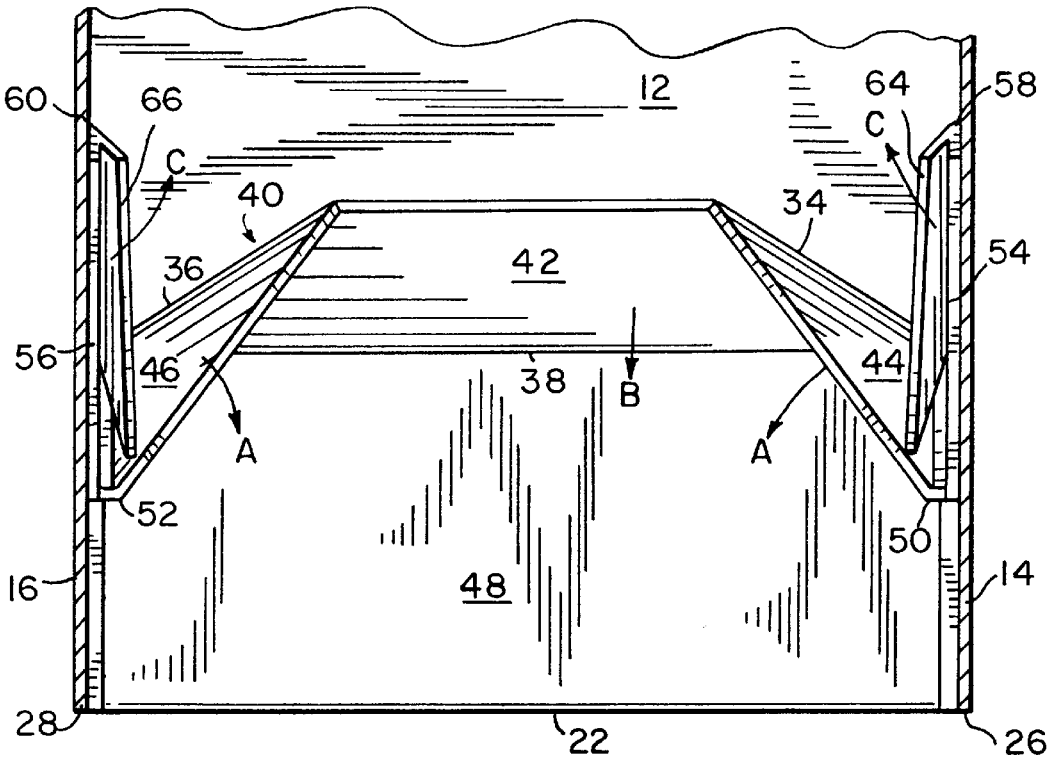
FIG. 5 is a broken-away, rear elevational view of the stand of FIG. 1 in a position intermediate the collapsed and erect conditions.

Referring now to the drawings, reference numeral 10 generally identifies a display stand shown in an erect or display condition in FIG. 1 and in a collapsed condition in FIG. 2. The stand 10 includes a main panel 12, and a pair of side panels 14, 16 foldably connected and hinged to the main panel 12 along fold lines 18, 20. All the panels are generally planar and constituted of a sheet material such as corrugated board material or cardboard. Main panel 12 is generally rectangular and rearwardly inclined in a manner resembling an easel. Main panel 12 has a lower edge 22 for engaging a generally horizontal support surface such as the ground, and an upper edge 24 that is elevated and rearwardly shifted relative to the lower edge 22. Each side panel 14, 16 has a generally triangular shape whose lower edges 26, 28 lie in a common plane with lower edge 22 to engage the ground.

In the collapsed condition of FIG. 2, the side panels 14, 16 overlie each other and the main panel 12 in a flattened state. A generally horizontal fold line 30, as best seen in FIG. 2, divides the collapsed stand into an upper half and a lower half which are folded to overlie each other to enable the folded, collapsed stand to be shipped in a minimum amount of cargo space. The side panels 14, 16 are manually unfolded about fold lines 18, 20 until they extend in mutual parallelism perpendicularly to the main panel 12 to assume the erect condition of FIG. 1.

In the erect condition, the stand serves as a display device. In its simplest embodiment, the stand can display artwork, graphics or the like directly on an outer surface of the main panel 12, in which case, the stand is useful as an advertising device, especially when made on a reduced scale for placement on a countertop. In another embodiment, the stand can support a picture or like medium and serve as a frame to support pictures on a desk or countertop.

In the preferred embodiment, the stand is used in a commercial setting to display merchandise to be offered for sale to consumers, especially in supermarkets, warehouse stores and department stores. To that end, the merchandise is placed on shelves mounted on the main panel 12. As illustrated in FIG. 1, a plurality of shelves 32 are mounted at different elevations on the main panel. Each shelf 32 is configured as a tray or bin having an open top and an open front to enable the consumer to have access to the merchandise placed in the bin. Non-illustrated hooks at the rear of each bin fit into corresponding non-illustrated slots on the main panel to secure the bin in place. The rearward inclined slant of the main panel allows the consumer to have greater access to the merchandise in the bins at the lower elevations closer to the floor. Bins are typically not placed at the upper or head region of the main panel. This upper region serves as a header and is reserved for graphics and data which depict information relating to the merchandise on display.

It will be recognized that the stand as described so far is not readily self-standing in the erect condition due to the tendency of the side panels to move apart, a situation that is aggravated when merchandise is placed in the bins 32. A rear support 40 is used to hold the side panels in a fixed position.

The rear support 40 includes a main section 42, and a pair of side sections 44, 46 foldably connected and hinged to the main section 42 along fold lines 34, 36. Main section 42 includes a main mounting section 48 that is in area contact with and secured to a lower rear surface of the main panel 12, preferably by glueing or stapling. As best seen in FIG. 4, the main mounting section 48 is of one-piece with, and hinged to, the main panel 12 along the lower edge 22 in the preferred embodiment. However, it is also contemplated that the main mounting section 48 be a separate piece that is secured to the main panel.

Side sections 44, 46 includes side mounting sections 54, 56 that are in area contact with and secured to a lower inside surface of the side panels 14, 16, respectively, preferably by glueing or stapling. Side sections 44, 46 are foldably connected and hinged to the mounting sections 54, 46 along fold lines 50, 52. Main section 42 is foldably connected and hinged to the mounting section 48 along fold line 38.

At least one locking flap, and preferably a pair of locking flaps 64, 66, is foldably connected and hinged to the mounting sections 54, 56 along fold lines 58, 60. Each flap 64, 66 has a tab 62 (see FIG. 4) projecting downwardly. Side sections 44, 46 have cutouts or openings 68, 70 through which a respective tab 62 extends, as explained below. In an alternate embodiment, the main mounting section 48, when fabricated as a separate piece, is secured to the main panel 12 upwardly of the main section 42. In that case, the locking flaps may be hinged to opposite ends of the main section 42.

The locking flaps 64, 66 lie flat between the side mounting sections 54, 56 and the main panel 12 in the collapsed condition of FIG. 2. The main section 42 lies flat between the main panel 12 and the side sections 44, 46. All the sections of the rear support 40 lie flat against one another between the side panels 14, 16 and the main panel 12.

Deployment of the sections of the rear support proceeds as follows: Starting from the collapsed condition, the side panels 14, 16 are manually unfolded outwardly about fold lines 18, 20. The outward movement of the side panels 14, 16 causes the side sections 44, 46 to move downwardly about the fold lines 50, 52 in the general direction of arrows A in FIG. 5. The downward movement of the side sections 44, 46 causes the main section 42 to move downwardly about the fold line 38 in the general direction of arrow B. The downward movement of the main section 42 continues until the main section lies in a plane generally perpendicular to the main panel 12, as best seen in FIG. 4. At this time, the side panels 14, 16 extend in mutual parallelism generally perpendicular to the main panel 12. The main section 42 is preferably slightly elevated relative to the side sections 44, 46, but could generally lie in the same plane therewith. The side sections 44, 46 preferably have a slightly upward slope in a transverse direction from a respective mounting section 54, 56 to the main section 42.

Figure 6:
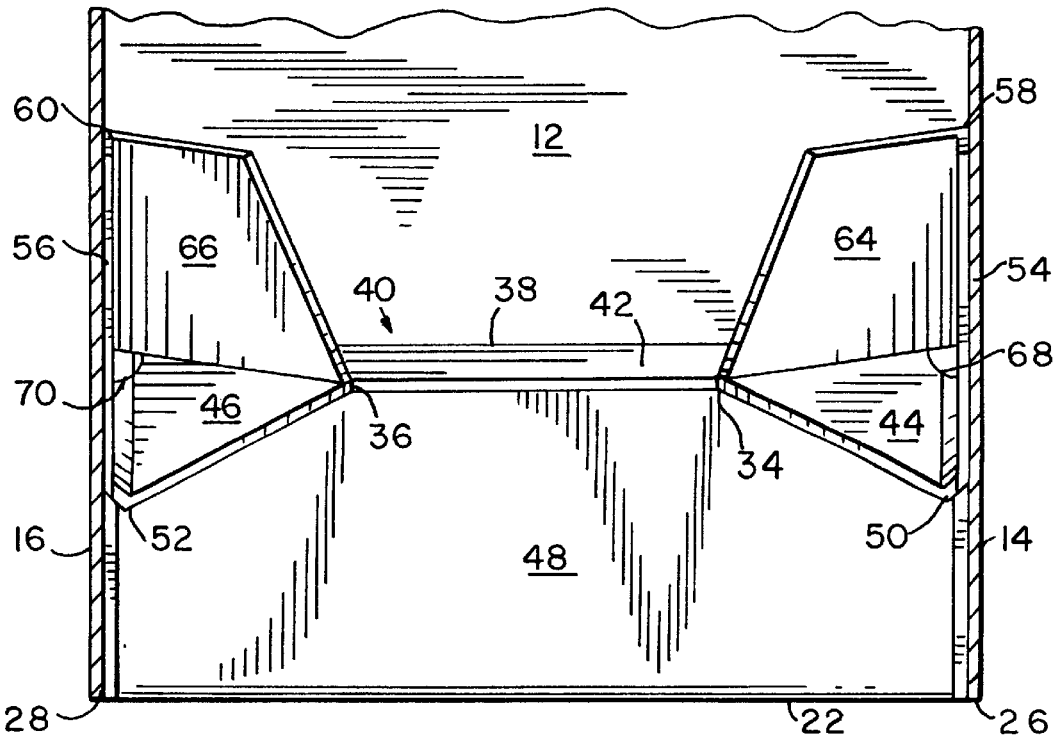
FIG. 6 is a view analogous to FIG. 5 of the stand in the erect condition.

The locking flaps 64, 66 are unfolded about fold lines 58, 60 toward each other in the general direction of the arrows C until the lower edges of the flaps 64, 66 overlie and engage the fold lines 34, 36 in the locking position shown in FIG. 6. This action preferably occurs automatically as the side panels are unfolded, but could also be performed manually. The fold lines 34, 36, as well as the flaps in the locking position, converge toward, and terminate short of, each other in a direction rearwardly away from the main panel. The lower edges of the flaps frictionally engage the sections 42, 44, 46, all along the fold lines 34, 36 and prevent the sections 42, 44, 46 from moving upwardly and bringing the side panels 14, 16 back into an overlapping relationship.

Rather than relying solely on friction to hold the flaps in the locking position, each tab 62 is moved along the openings 68, 70 until the respective tab 62 abuts against a linear abutment edge 74 (see FIG. 4) that bounds the respective opening and extends partly along the respective fold lines 34, 36. The respective opening 68, 70 has a reduced radial distance as measured radially from the fold lines 58, 60 along the abutment edge. The reduced radial dimension as compared to the corresponding radial dimension of the respective tab causes the tab to be wedged in place, thereby retaining the flaps in the locking position shown in FIG. 5.

Once in the erect condition, the shelves 32 can be mounted on the front of the main panel. The merchandise is then loaded on the shelves. To collapse the stand, once the shelves are removed, the flaps 64, 66 are pushed outwardly in the direction opposite to arrows C with a sufficient force to overcome the wedged engagement of the tabs. Thereupon, the main section 42 is pushed up in the direction opposite to that of arrow B. This movement causes the side sections 44, 46 to move up in the direction opposite to the arrows A and, in turn, causes the side panels 14, 16 to move into their initial overlapping relationship. The upper and lower halves of the collapsed stand are then folded about fold line 30 to prevent the collapsed stand from unfolding.

The rear support 40 and the flaps 64, 66 are preferably constituted of a single piece of sheet material such as corrugated board or cardboard. As previously noted, in the preferred embodiment, the rear support 40, the flaps 64, 66 and the panels 12, 14, 16 are all constituted of a single sheet, since they are integrally connected at the living hinge 22. A one-piece construction greatly reduces construction and assembly costs.

As described so far, the display stand has three panels and, hence, an open back. It is also contemplated that the back of the stand be closed by providing a back panel hinged to either side panel, or by providing a pair of back panel portions hinged to both side panels. By folding the back panel or back panel portions into an overlying relationship with the main panel, the stand is closed, a feature which is desirable in some applications, not only for its aesthetic value, but also for increased structural rigidity. The display stand, once erected and locked as described above, is a reliably self-standing device which is highly resistant to tipping if bumped or knocked.

It will be understood that each of the elements described above, or two or more together, also may find a useful application in other types of constructions differing from the types described above.

While the invention has been illustrated and described as embodied in a tipping-resistant, merchandise display stand, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by letters patent is set forth in the appended claims.

I claim:

1. A tipping-resistant display stand, comprising:

a) a display including a main panel having an outer front surface and an inner rear surface opposite to the front surface, and a pair of side panels foldably connected to the main panel and movable to an erect condition in which the side panels extend along a rearward direction away from the main panel;

b) a rear support including a main section foldably connected to the main panel and extending along the rearward direction away from the rear surface of the main panel in the erect condition, and a pair of side sections foldably connected to the side panels and extending away from the side panels towards each other in a transverse direction transverse to the rearward direction in the erect condition, said side sections being foldably connected to the main section along fold lines that extend along both said transverse and rearward directions; and c) a locking flap foldably connected to one of the side and main sections of the rear support and movable away from the main and side panels to a locked condition in which the flap extends along both said transverse and rearward directions and over one of said fold lines between said main and side sections of said rear support.

2. The stand according to claim 1, wherein each of the side sections includes a side mounting portion in surface area contact with a respective side panel; and wherein the main section includes a main mounting portion in surface area contact with the main panel.

3. The stand according to claim 2, wherein the locking flap is foldably connected to one of the side mounting portions.

4. The stand according to claim 1, wherein each of the panels is generally planar, and wherein the side panels extend in mutual parallelism along the rearward direction away from the main panel.

5. The stand according to claim 1, wherein the main panel has a lower edge, and an upper edge located above, and spaced along the rearward direction relative to, the lower edge; and wherein the side panels are connected to the main panel along crease lines that extend between the upper and lower edges of the main panel.

6. The stand according to claim 1, wherein the fold lines converge toward, but terminate short of, each other along the rearward direction.

7. The stand according to claim 1, wherein the display and the rear support are constituted of a single piece of sheet material.

8. The stand according to claim 1, wherein the locking flap engages said one fold line in the locked condition.

9. The stand according to claim 1, wherein the locking flap has a tab, and wherein the rear support has an opening through which the tab extends in the locked condition.

10. The stand according to claim 1, and further comprising an additional locking flap foldably connected to another of the side and main sections of the rear support and movable away from the main and side panels to the locked condition in which the additional flap extends along both said transverse and rearward directions and over the other of said fold lines between said other one of the main and side sections of said rear support, said flaps converging toward, but terminating short of, each other along the rearward direction.

11. A tipping-resistant display stand, comprising:

a) a display including a main panel having an outer front surface and an inner rear surface opposite to the front surface, a shelf mounted on the front surface for supporting items on display, and a pair of side panels foldably connected to the main panel and movable to an erect condition in which the side panels extend along a rearward direction away from the main panel;

b) a rear support including a main section foldably connected to the main panel and extending along the rearward direction away from the rear surface of the main panel in the erect condition, and a pair of side sections foldably connected to the side panels and extending away from the side panels towards each other in a transverse direction transverse to the rearward direction in the erect condition, said side sections being foldably connected to the main section along fold lines that extend along both said transverse and rearward directions; and c) a pair of locking flaps each foldably connected to a respective one of the side and main sections of the rear support and movable away from the main panel and a respective side panel to a locked condition in which the flaps extend along both said transverse and rearward directions, converge toward, and terminate short of, each other, and overlie the fold lines between said main and side sections of said rear support.

12. The stand according to claim 11, wherein each of the side sections includes a side mounting portion in surface area contact with a respective side panel; and wherein the main section includes a main mounting portion in surface area contact with the main panel.

13. The stand according to claim 12, wherein each locking flap is foldably connected to a respective side mounting portion.

14. The stand according to claim 11, wherein each of the panels is generally planar, and wherein the side panels extend in mutual parallelism along the rearward direction away from the main panel.

15. The stand according to claim 11, wherein the main panel has a lower edge, and an upper edge located above, and spaced along the rearward direction relative to, the lower edge; and wherein the side panels are connected to the main panel along crease lines that extend between the upper and lower edges of the main panel.

16. The stand according to claim 11, wherein the display and the rear support are constituted of a single piece of sheet material.

17. The stand according to claim 11, wherein each locking flap has a tab, and wherein the rear support has a pair of openings through which a respective tab extends in the locked condition.

18. The stand according to claim 11, wherein the locking flaps, the rear support and the display are constituted of corrugated board sheet material.

* * * * *